US011139605B2

(12) United States Patent
Metzler et al.

(10) Patent No.: US 11,139,605 B2
(45) Date of Patent: Oct. 5, 2021

(54) PLUG CONNECTOR WITH LATCH HOOKS

(71) Applicant: HIRSCHMANN AUTOMOTIVE GMBH, Rankweil/Brederis (AT)

(72) Inventors: Andreas Metzler, Muntlix (AT); Markus Kalb, Dornbirn (AT); Dominic Pfeiffer, Dornbirn (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 0 days.

(21) Appl. No.: 16/635,351

(22) PCT Filed: Sep. 7, 2018

(86) PCT No.: PCT/EP2018/074116
§ 371 (c)(1),
(2) Date: Jan. 30, 2020

(87) PCT Pub. No.: WO2019/048602
PCT Pub. Date: Mar. 14, 2019

(65) Prior Publication Data

US 2020/0373708 A1 Nov. 26, 2020

(30) Foreign Application Priority Data

Sep. 7, 2017 (DE) ..... 102017120579.9

(51) Int. Cl.
*H01R 13/422* (2006.01)
*H01R 13/514* (2006.01)
(Continued)

(52) U.S. Cl.
CPC ..... *H01R 13/4223* (2013.01); *H01R 13/424* (2013.01); *H01R 13/514* (2013.01); *H01R 13/6272* (2013.01); *H01R 13/6273* (2013.01)

(58) Field of Classification Search
CPC ..... H01R 13/672; H01R 13/6273; H01R 13/4223; H01R 13/424; H01R 13/514; H01R 2201/26
(Continued)

(56) References Cited

U.S. PATENT DOCUMENTS 5,299,958 A * 4/1994 Ohsumi ..... H01R 13/4362 439/752
5,435,744 A * 7/1995 Derstine ..... H01R 13/5045 439/352
(Continued)

*Primary Examiner* — Peter G Leigh
(74) *Attorney, Agent, or Firm* — Andrew Wilford

(57) ABSTRACT

The invention relates to a plug connection (1) having a plug connector (2) and a mating plug connector (3). The plug connector (2) and the mating plug connector (3) can be plugged together in order to form the plug connection (1), wherein the plug connector (2) has a contact support (4) with at least one contact chamber for receiving a contact partner, the contact support (4) is inserted into an outer housing (5) of the plug connector (2), each contact partner is primarily locked in the respective contact chamber, and a secondary lock (6) is provided for a secondary locking of the contact partners in the respective contact chambers. The invention is characterized in that the outer housing (5) has at least one locking hook (13) which interacts with the contact support (4). The contact support (4) has a hook mating geometry (14), and the at least one locking hook (13) is aligned diagonally to a central axis of the outer housing (5).

5 Claims, 13 Drawing Sheets

(51) Int. Cl.
*H01R 13/627* (2006.01)
*H01R 13/424* (2006.01)

(58) Field of Classification Search
USPC ..... 439/357
See application file for complete search history.

(56) References Cited

U.S. PATENT DOCUMENTS

| | | | | |
|---|---|---|---|---|
| 6,264,497 | B1 * | 7/2001 | Murakami | H01R 4/2433 439/417 |
| 7,347,745 | B1 * | 3/2008 | Raudenbush | H01R 13/4223 439/595 |
| 7,500,887 | B2 * | 3/2009 | Ichio | H01R 13/4362 439/595 |
| 8,342,891 | B2 * | 1/2013 | Fukushi | H01R 4/4836 439/752 |
| 8,721,375 | B2 * | 5/2014 | Hori | H01R 13/4362 439/752 |
| 2005/0159039 | A1 | 7/2005 | Matsunaga | |
| 2007/0281555 | A1 * | 12/2007 | Suemitsu | H01R 13/424 439/752 |
| 2015/0013157 | A1 * | 1/2015 | Kutsuna | H01R 13/424 29/876 |
| 2015/0340793 | A1 * | 11/2015 | Kutsuna | H01R 13/4362 439/733.1 |
| 2017/0207575 | A1 * | 7/2017 | Jabrane | H01R 13/4362 |
| 2017/0207578 | A1 * | 7/2017 | Abraham | H01R 13/4362 |
| 2017/0207594 | A1 * | 7/2017 | Jabrane | H01R 13/639 |

* cited by examiner

PLUG CONNECTOR WITH LATCH HOOKS

CROSS REFERENCE TO RELATED APPLICATIONS

This application is the US-national stage of PCT application PCT/EP2018/074116 filed 7 Sep. 2018 and claiming the priority of German patent application 102017120579.9 itself filed 7 Sep. 2017.

FIELD OF THE INVENTION

The invention relates to a plug-type connector comprising a plug and a socket that can be plugged together to form the plug-type connector, wherein the plug has a contact support with at least one contact chamber for receiving a contact partner and the contact support is inserted into an outer housing of the plug, wherein each contact partner undergoes primary locking in its contact chamber and a secondary locking bar is provided for secondary locking of the contact partners in their contact chambers according to the features of the introductory clause of claim 1.

Plugs of such plug-type connectors are known that have a contact support. The contact support has at least one contact chamber, generally a plurality of contact chambers, into each of which a respective contact partner is inserted. The contact partner is at the end of an electrical conductor. For the plug to function reliably, the contact partner undergoes primary locking in its associated contact chamber. This takes place, for example, by means of a spring clip that projects from the contact partner and comes to lie against an undercut in the contact chamber when the contact partner has been inserted into the contact chamber in its intended target position.

It is moreover known that the contact partner not only undergoes primary locking in its contact chamber, but that so-called secondary locking also takes place. Such secondary locking takes place, for example, by means of locking clips, locking bars or the like.

For the plug-type connector to function during operation, i.e. when the plug has been plugged into the socket, it is necessary for these two elements to be permanently and reliably connected to one another. To this end, locking elements, so-called CPAs (Connector Position Assurance) are already known.

In addition, for the plug of the plug-type connector to function, it is, however, also necessary for the contact support to be reliably and permanently fastened in its intended target position in its outer housing. Depending on the embodiment of the plug, this intended target position can be an end position, when the contact support has been inserted into the outer housing. However, it can also be a prelatching position, into which the contact partner is firstly brought with respect to the outer housing, wherein further measures then take place (such as inserting the contact partners, for example) and only then is the contact support brought into its intended target position in the outer housing. In both cases, it can disadvantageously occur that, although the contact support has been inserted into its outer housing, it can move back out of this position in the course of further assembly or plugging-in procedures, which means that these further assembly or plugging-in procedures are unable to take place reliably, i.e. are prone to errors.

OBJECT OF THE INVENTION

The invention is therefore based on the object of improving a generic plug and preventing the disadvantages outlined at the outset.

SUMMARY OF THE INVENTION

This object is achieved according to the invention in that the outer housing has at least one latch hook cooperating with the contact support, wherein the contact support has a hook-complementary formation, and the at least one latch hook is aligned at an angle to a center axis of the outer housing. The at least one latch hook ensures the plugging-in procedure of the contact support in its outer housing, i.e. this procedure is not hindered by the latch hooks. Only when the contact support has been inserted as intended into the outer housing (either in its intended end position or in an intended prelatching position that is assumed prior to the assumption of the end position), does the latch hook, in particular the free end thereof, cooperate with the hook-complementary formation of the contact support and result in the contact support no longer being able to move out of the outer housing. To move it out, should this be necessary, it would be necessary to release the at least one latch hook from the hook-complementary formation and then pull the contact support out of its outer housing.

The at least one latch hook is fixedly arranged with its one end on the outer housing, whereas its other end is configured as a free end. It is thus possible for the, in particular, elongated latch hook to be deflected as the contact support is inserted into the outer housing, whereas it assumes its original starting position again when the contact support is inserted as intended into the outer housing and the free end of the latch hook has come to lie against the hook-complementary formation of the contact support. Therefore, as a result of the angled alignment of the latch hook with respect to the center axis of the outer housing, the deflection during the insertion procedure of the contact support into the outer housing is ensured on the one hand, while, on the other hand, it is also ensured after the completion of the insertion procedure that the contact support can no longer be moved out of the housing.

In a further development of the invention, it is provided that two latch hooks are on the outer housing such that they are symmetrical with respect to the center axis of the outer housing. As a result of this configuration, not only is a considerably enhanced fastening of the contact support in its outer housing realized, but the contact support is also specifically guided when it is inserted into its outer housing and slides with its outer contour along the two latch hooks.

In a further development of the invention, it is provided that the free end of the at least one latch hook and the hook-complementary formation form mutually complementary undercuts. While, on the one hand, it is conceivable that the free end of the latch hook, like the contact surface of the hook-complementary formation, has a flat design and therefore the free end of the latch hook comes to lie plane-parallel against the hook-complementary formation, it is, on the other hand, advantageously conceivable that an undercut is provided, which contributes to a defined fastening of the contact support in the desired position in its outer housing and, moreover, again contributes to the effect that the contact support can no longer be moved out of its outer housing without being subjected to relatively high forces that do not generally occur during the further assembly.

Further configurations of the invention are revealed in the subclaims, in which further advantages are revealed that will be explained further in conjunction with the description of the figures.

BRIEF DESCRIPTION OF THE INVENTION

An embodiment of the invention is illustrated in the figures and explained in more detail below. Therein:

FIG. 1 is a side, exploded, longitudinal section through the connector of this invention;

FIGS. 2, 3, and 4 are perspective longitudinal sections through the parts of the connector;

FIGS. 5, 6, and 7 are perspective views of the parts of the connector;

Figure 12A:
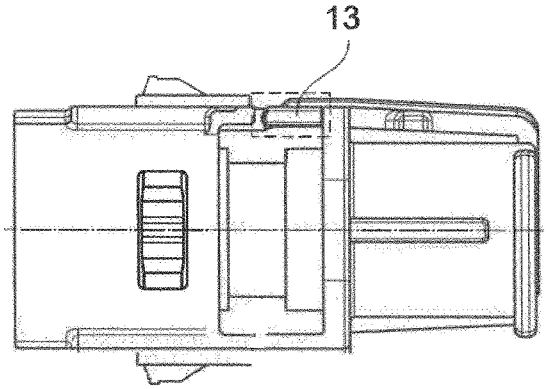
FIGS. 12A and 13A are side and top views of the part of FIG. 8.
Figure 12B:
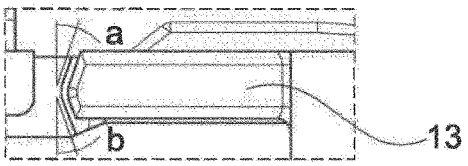
Figure 13A:
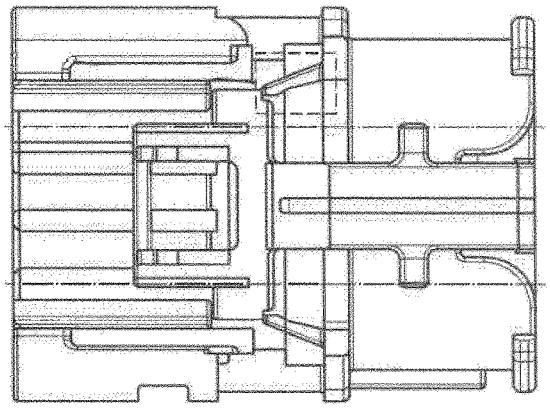
Figure 13B:
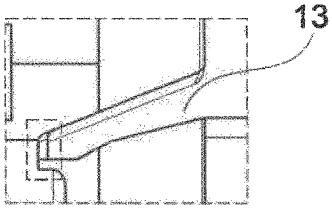
Figure 13C:
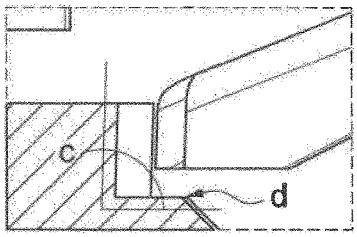
Figure 14A:
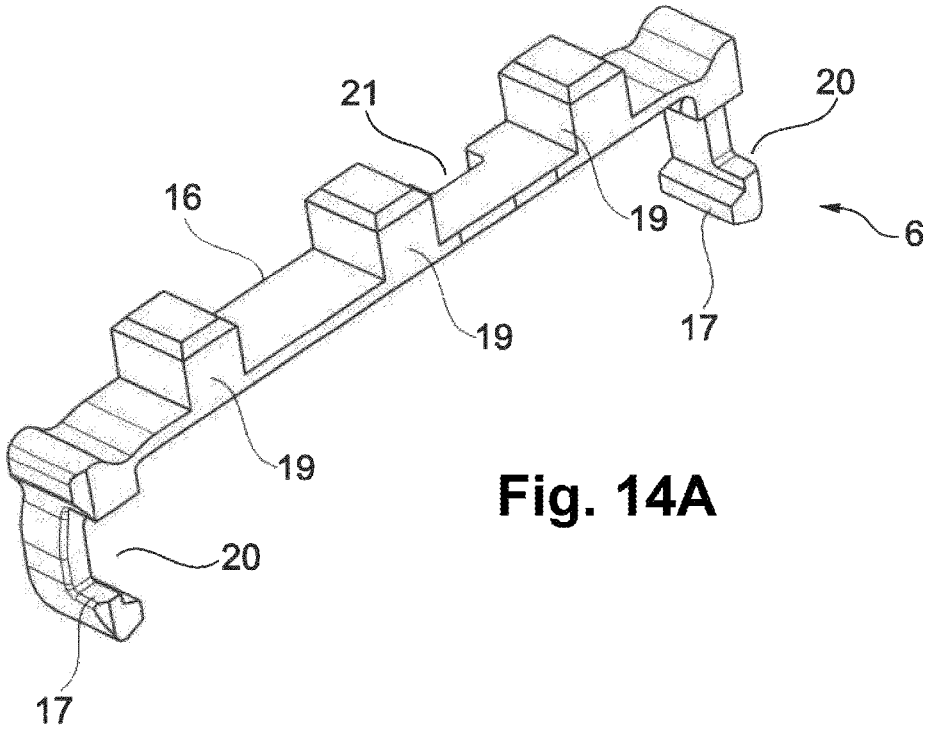
Figure 14B:
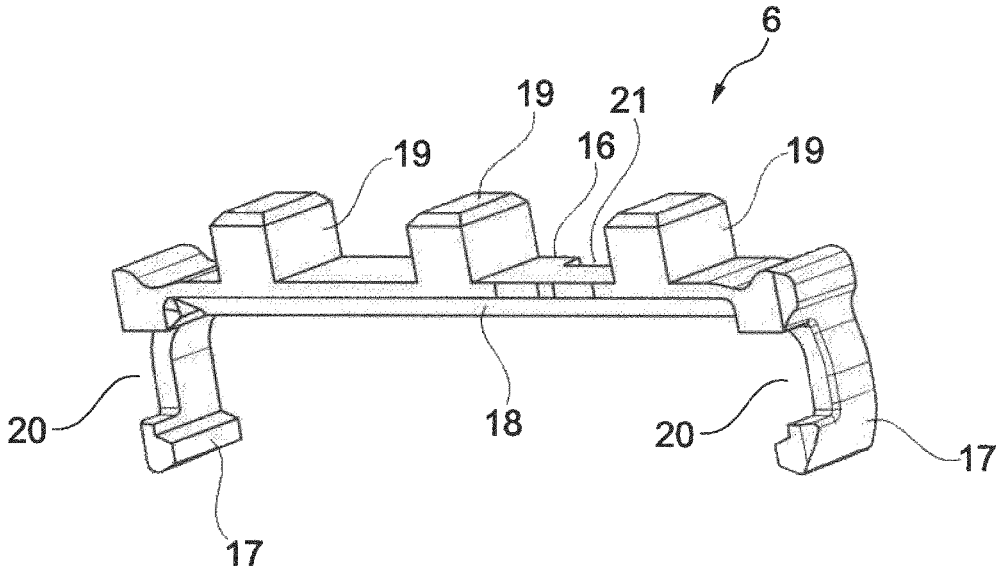
Figure 15A:
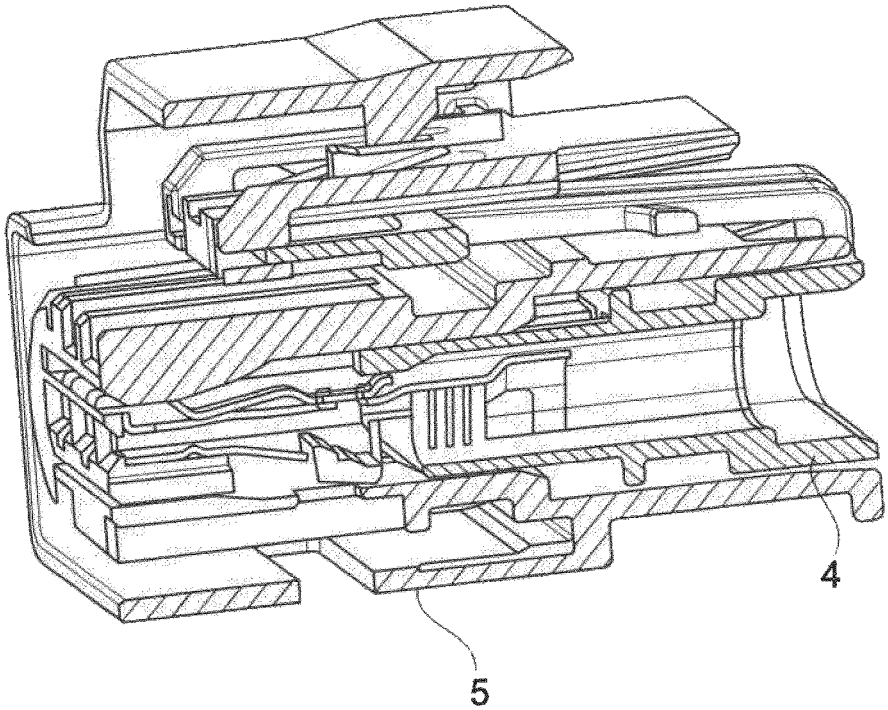
Figure 15B:
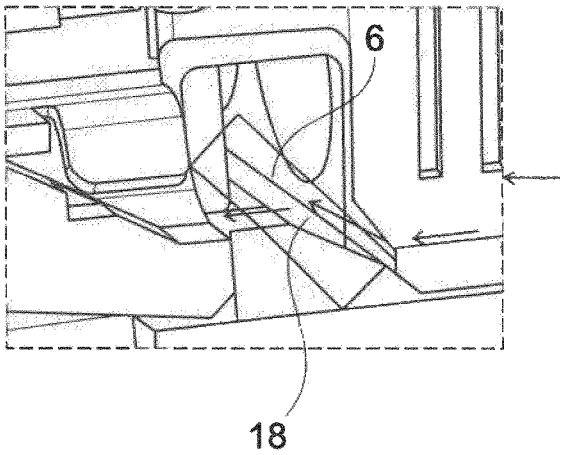
Figure 16A:
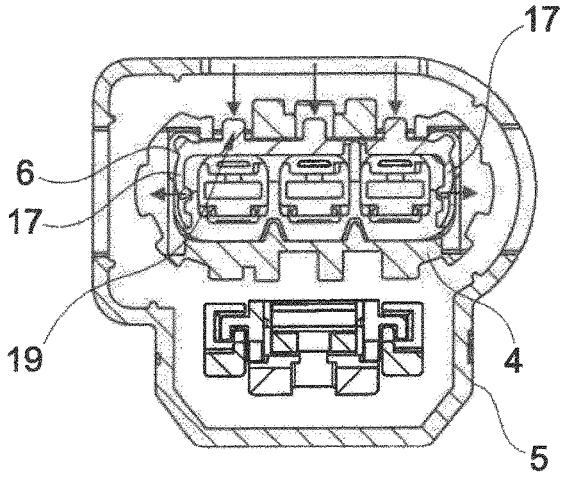
Figure 16B:
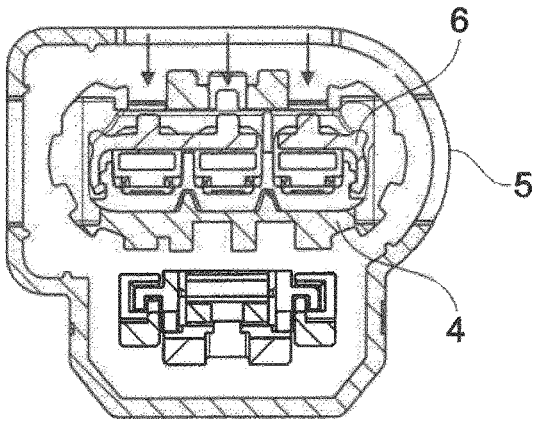
Figure 16C:
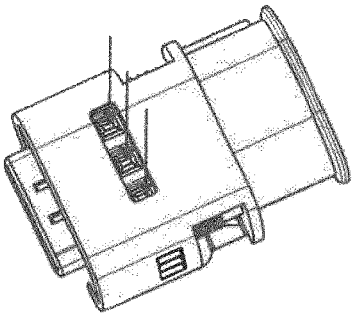
Figure 17A:
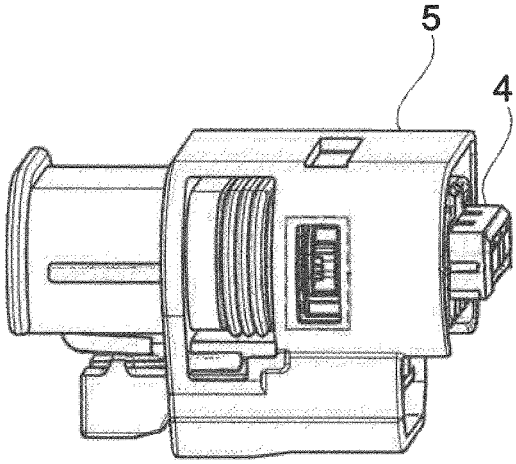
Figure 17B:
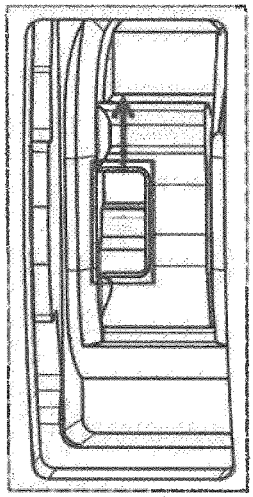
Figure 17C:
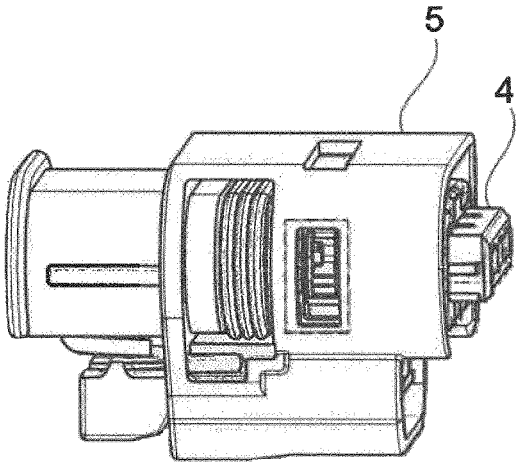
Figure 17D:
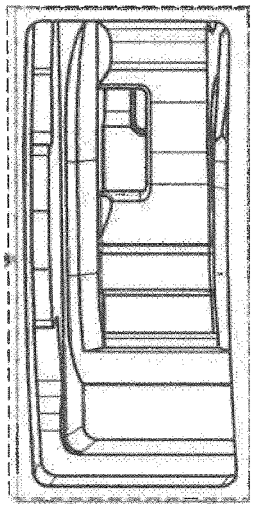
Figure 18A:
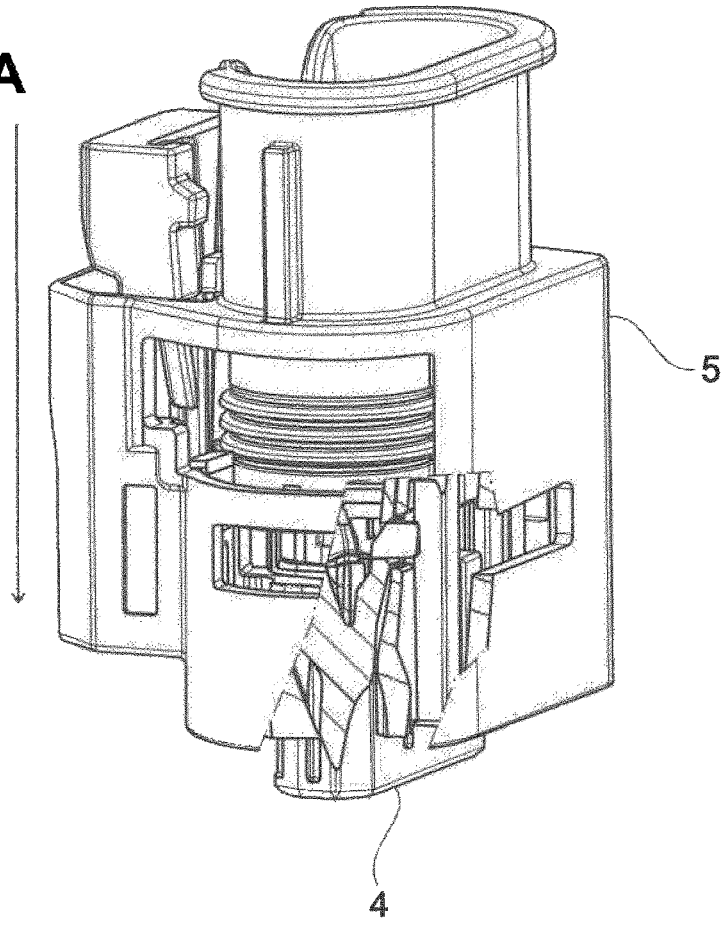
Figure 18B:
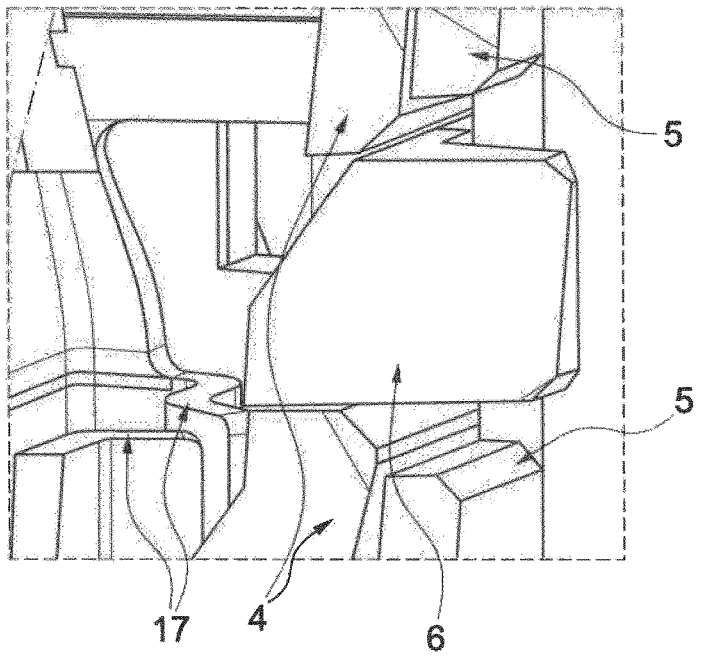
Figure 19A:
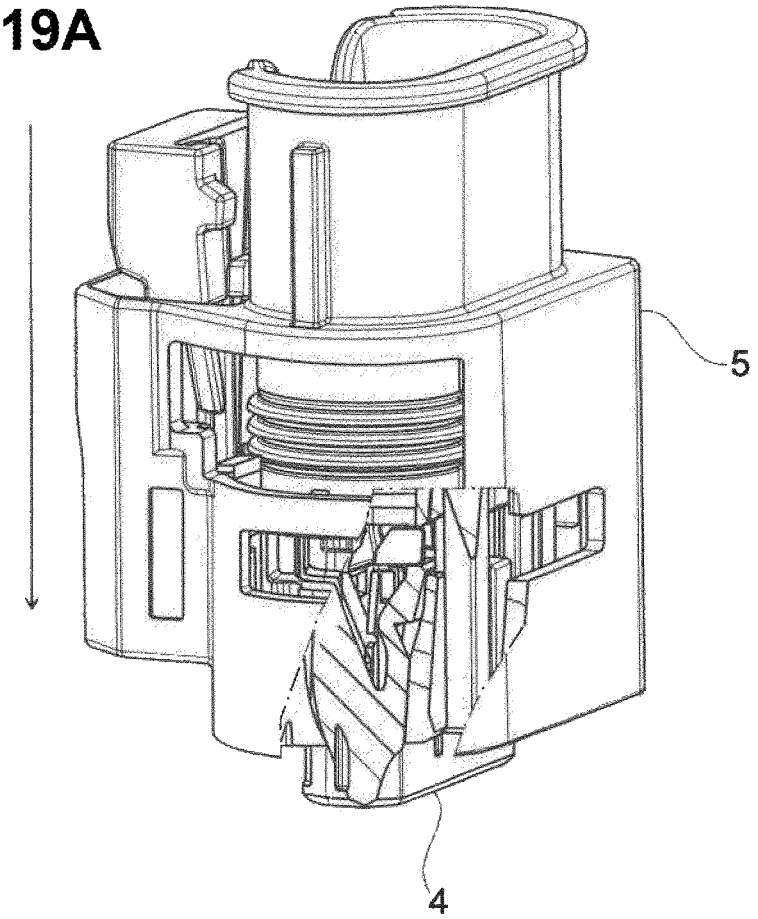
Figure 19B:
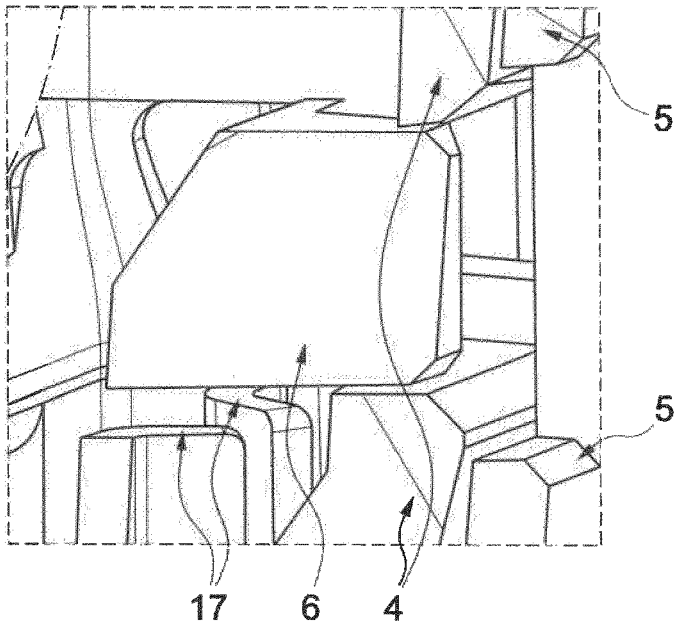
Figure 20A:
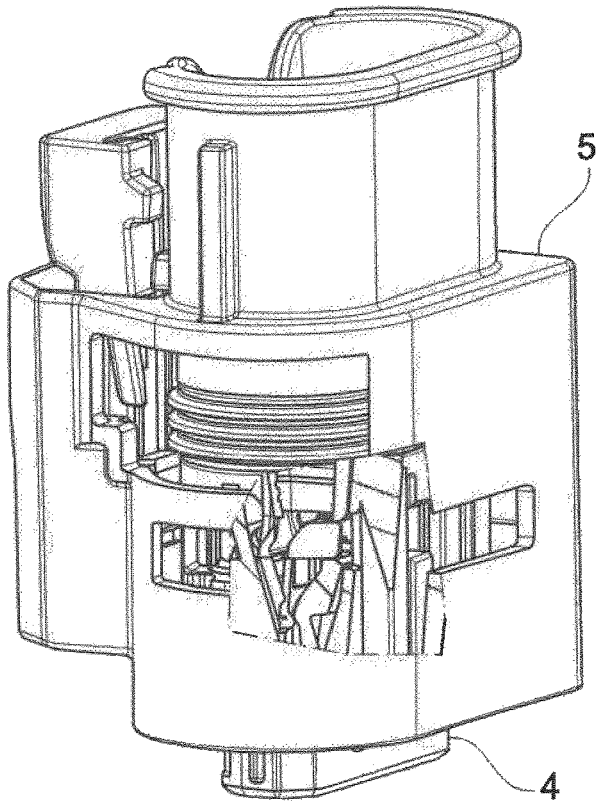
Figure 20B:
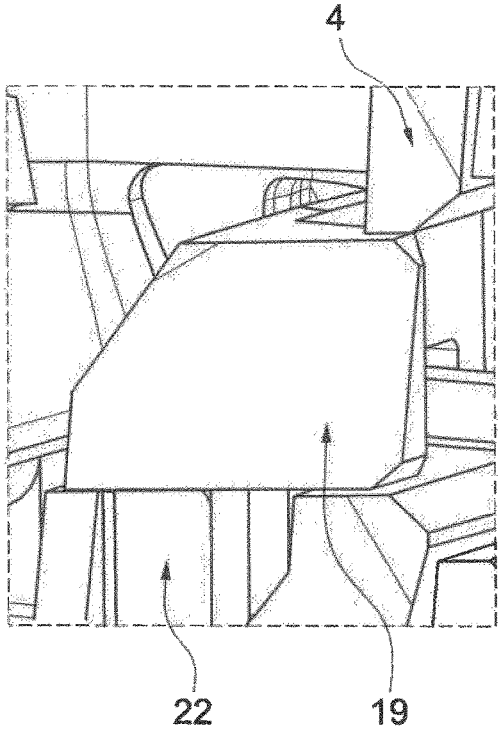
Figure 21A:
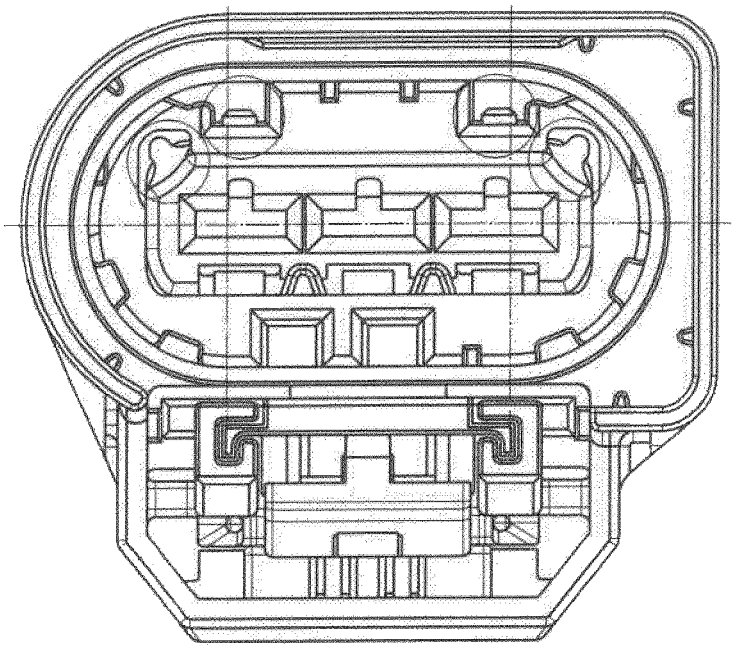
Figure 21B:
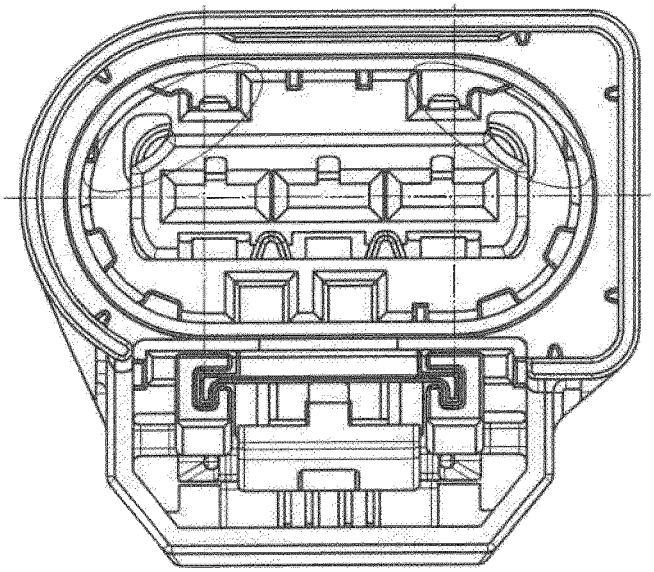

FIGS. 12B, 13B, and 13C are large scale views of the details indicated in the broken-line rectangles in FIGS. 12A, 13A, and 13B;

FIGS. 14A and 14B are large-scale perspective views of an element of the locking bar of the connector;

FIGS. 15A and 15B are longitudinal-sectional and detail views of the connector;

FIGS 16A, 16B, and 16C are further sectional and perspectivew views of the connector;

FIGS. 17A, 17B, 17C, and 17D are side perspective and large-scale end views of the connector;

FIGS. 18A, 19A, and 20A are partly sectional side perspetive views of the connector in different positions;

FIGS. 18B, 19B, and 20B are large-scale views of details from respective FIGS. 18A, 19A, and 20A; and FIGS. 21A and 21B are end views of the connector,

SPECIFIC DESCRIPTION OF THE INVENTION

An embodiment of the invention is illustrated in the figures and explained in more detail below.

Figure 1:
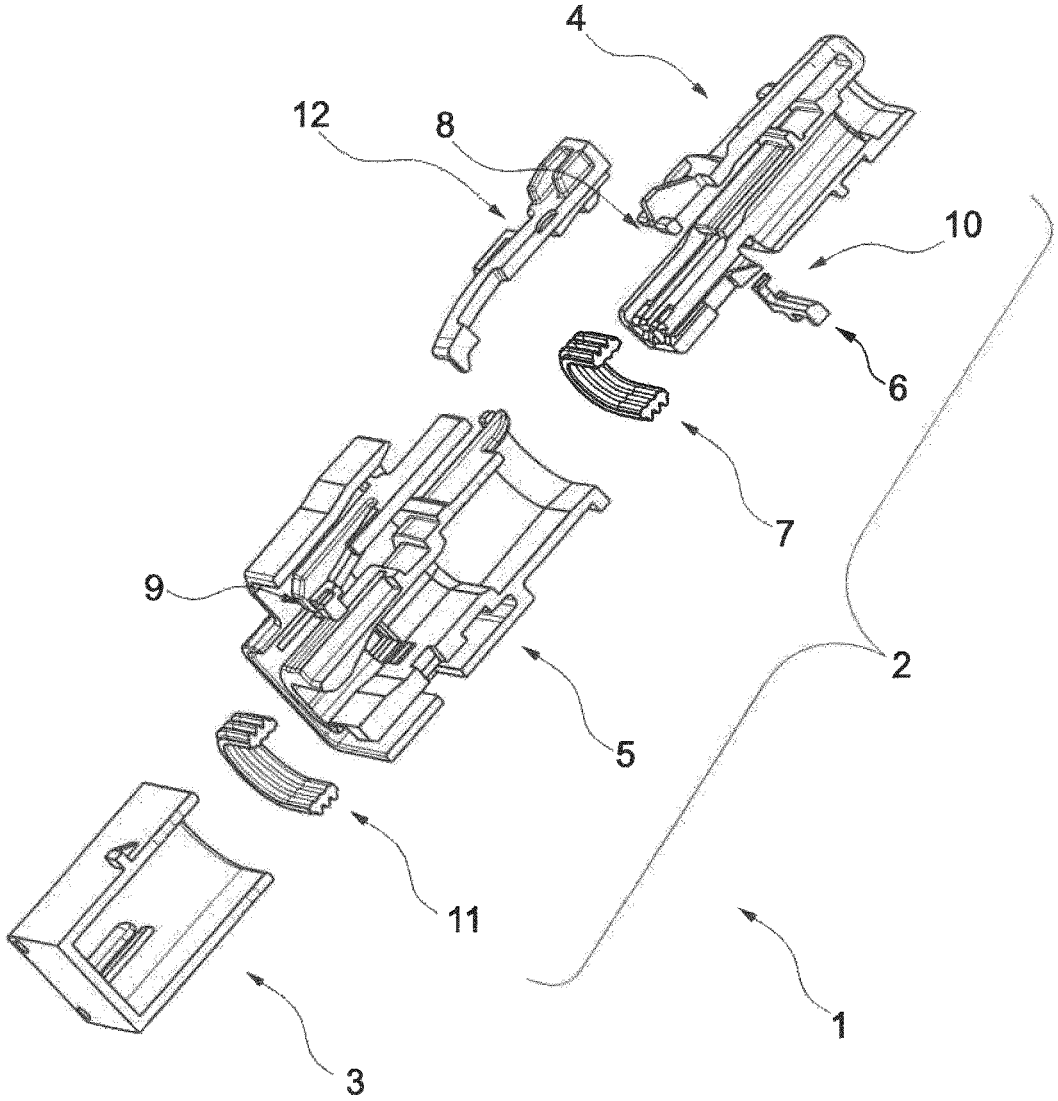

FIG. 1, as far as is shown in detail, shows a plug-type connector 1. This plug-type connector 1 comprises a plug 2 and a socket 3 that can be plugged together with said plug. Some elements of the plug-type connector 1 (such as electrical conductors, for example, at the ends of which contact partners are) have been omitted for a clearer view, although they are essentially known and present in practice.

The plug 2 is formed by a contact support 4 that has contact chambers (not illustrated in more detail) for the contact partners. The contact support 4 is inserted into an outer housing 5 (also referred to as a protective shroud). The contact partners inserted into the contact chambers undergo (so-called) primary locking in a suitable manner that is known per se. Moreover, secondary locking takes place by means of a secondary locking bar 6 that can be, but does not have to be, present. For sealing purposes and for achieving longitudinal watertightness, a seal, in particular constructed as a lip seal 7, is inserted between the contact support 4 and the outer housing 5. A locking element 8 (for the contact support 4) and/or a locking element 9 (for the outer housing 5) and/or a locking element 10 (for the secondary locking bar 6) can be, but do not have to be, present as further elements of the plug-type connector 1. For achieving sealing and longitudinal water tightness, a further sealing element, in particular again a lip seal 11, is provided between the plug 2 and the socket 3 (that is also referred to as a plug base). For permanently securing the plug-type connector 1 formed by the plug 2 and the socket 3, a further locking element is present, namely a CPA 12 that is known per se.

Figure 3:
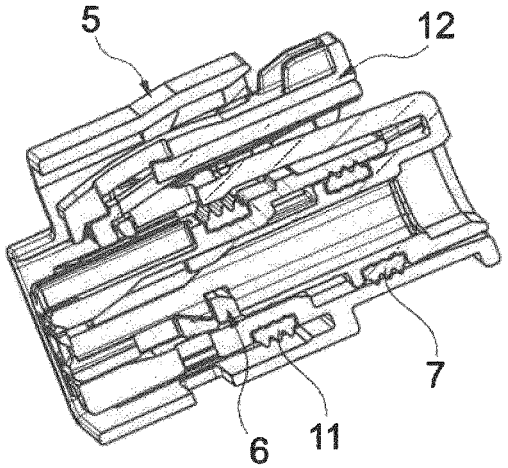
Figure 4:
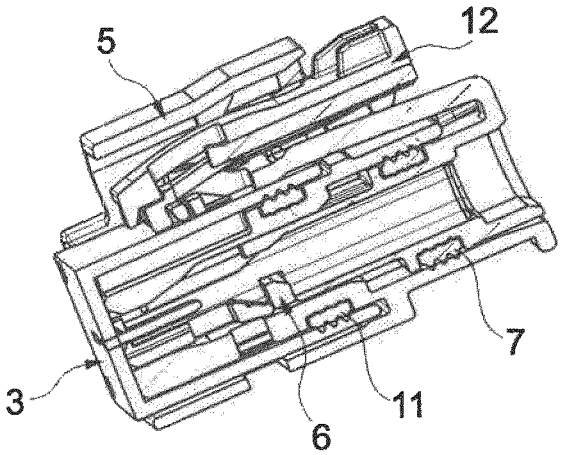

Assembly of the above-mentioned elements is explained below with reference to FIGS. 2 to 4.

Figure 2:
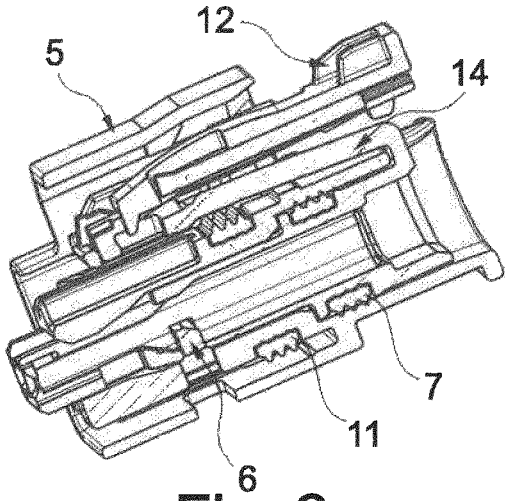

In FIG. 2, it is shown that the contact support 4 has been inserted to some extent into its outer housing 5 so that it is located in the outer housing 5 in a first position that is referred to as the prelatching position. Starting from this prelatching position, it is possible to move the contact support 4 further into the outer housing 5 until the intended end position has been reached. In the prelatching position, as shown in FIG. 2, the contact support 4 projects for example 3.45 mm out of the outer housing 5. Larger or smaller distances are, of course, also conceivable. After the contact partners (for example contact sockets) have been inserted into their associated contact chambers in the contact support 4 and undergone primary locking therein, the secondary locking of the contact partners in their contact chambers takes place by means of the secondary locking bar 6. The further assembly of the plug 2 and the plugging together of the plug 2 and its socket 3 then take place. As soon as the contact support 4, still projecting out of the outer housing 5 in the prelatching position, has come to lie against a bearing region, for example the bottom of the socket 3, the outer housing 5 is likewise displaced into the contact region (in particular to the base) of the socket 3, whereby the outer housing 5 and the contact support 4 are pushed further inside one another so that the contact support 4 is then arranged as intended in its end position in the outer housing 5 and the outer housing 5 and the contact support 4 form a planar surface at their end face (i.e. in the direction of the socket 3). As a result of this state (illustrated in FIG. 3), the contact support 4 is therefore fastened as intended in its outer housing 5. This position can also be referred to as an end latching position of the plug 2. As illustrated in FIG. 4, the plugging-in of the socket 3 into the plug 2 prepared in the manner described above subsequently takes place so that the plug-type connector 1 is thereby plugged together. Finally, this plug-type connector 1 is secured by actuating the CPA 12 so that it is not possible to move the socket 3 back out of the plug 2 without releasing the CPA 12.

Figure 5:
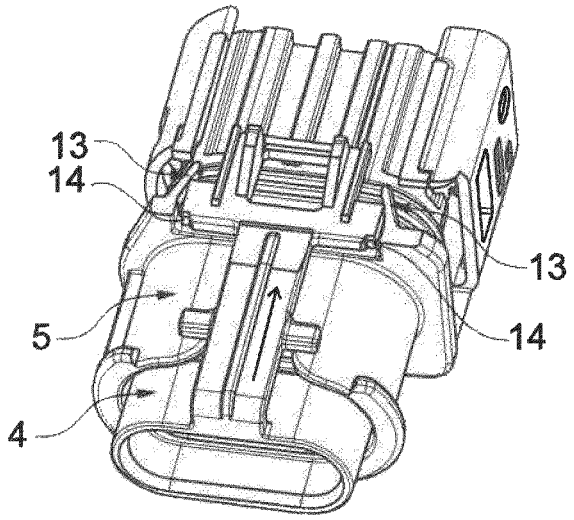

It can be seen from FIG. 2 that the contact support 4 has been brought into a first position relative to the outer housing 5, this being the described prelatching position. To effectively prevent the contact support 4 from being able to move from this prelatching position out of the outer housing 5, the outer housing 5, according to the invention, has at least one latch hook 13 cooperating with the contact support 4, wherein the contact support 4 has a hook-complementary formation 14 and the at least one latch hook 13 is aligned at an angle to a center axis of the outer housing 5. This is illustrated in FIG. 5, wherein an embodiment is shown here, in which two latch hooks 13 are on the outer housing 5 such that they are symmetrical with respect to the center axis of the outer housing 5.

Figure 6:
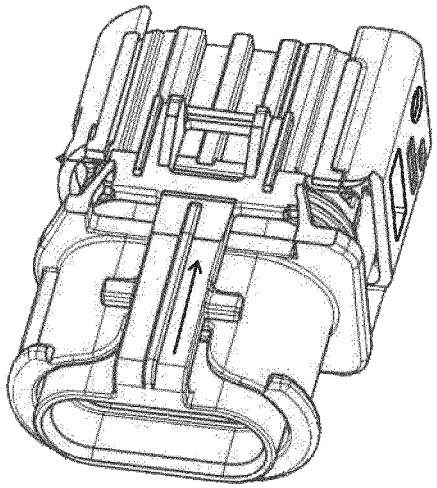
Figure 7:
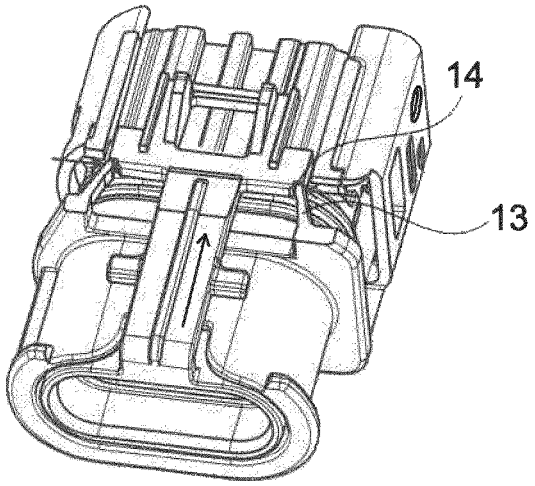
Figure 8:
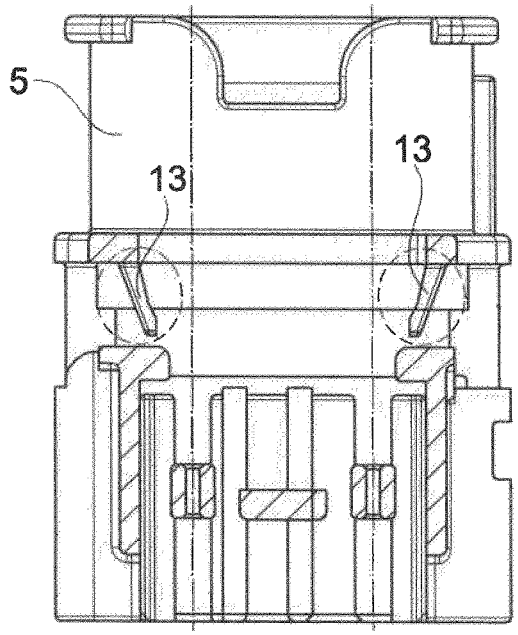
FIG. 8 is a large-scale longitudinal section through a part of the connector.
Figure 9:
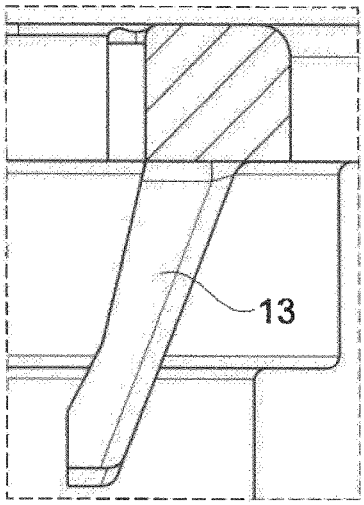
FIG. 9 is a large scale view of the detail in the broken-line circle of FIG. 8.

During assembly (insertion) of the contact support 4 into its outer housing 5, the two latch hooks 13 are spread apart to the left and right so that the contact support 4 can be inserted (pushed) into the outer housing 5, guided through these two spread-apart latch hooks 13. If the contact support 4 has then been brought into its intended position (for example the prelatching position), the two latch hooks 13 are restored back to their original position and come to lie against the hook-complementary formation 14 and thereby prevent the contact support 4 from being able to be moved from its assumed position out of the outer housing 5. The procedure of sliding the contact support 4 along the two deflected latch hooks 13 is illustrated in FIG. 6, wherein it can be seen from FIG. 7 that the respective free end of the two latch hooks 13 has come to lie against the hook-complementary formation 14. In this case, the alignment of the latch hooks 13 before and after the insertion of the contact support 4 into its outer housing 5 is preferably virtually identical or even completely identical.

Both the latch hooks 13 of the outer housing 5 and the hook-complementary formation 14 of the contact support 4 are again illustrated in various perspective views in FIGS. 8 to 11.

Figure 10:
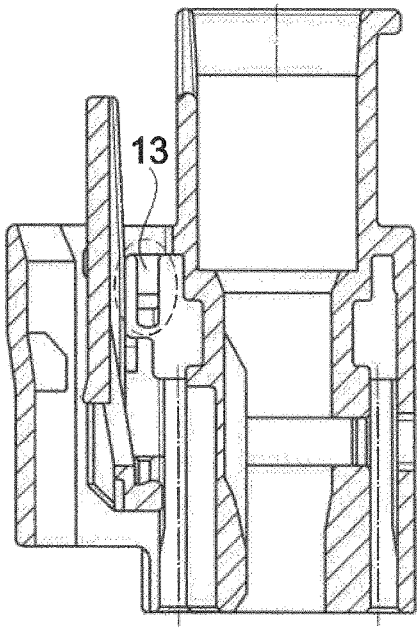
FIG. 10 is another section through the part shown in FIG. 8.
Figure 11:
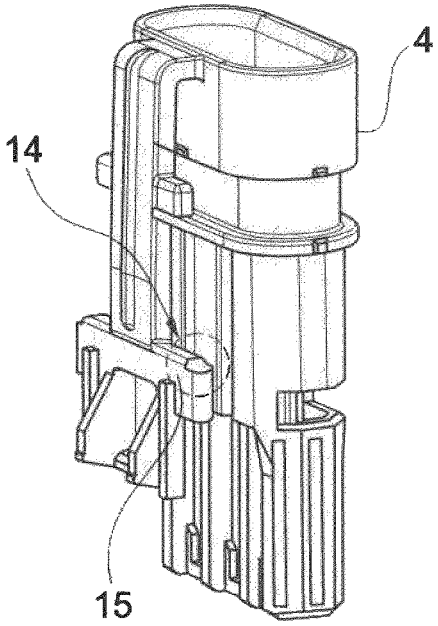
FIG. 11 is a perspective view of the part of FIG. 8.

With reference to FIGS. 10 and 11, it should be explained that the hook-complementary formation 14 is at an end of a transverse web 15 extending from the center axis of the contact support 4. As can be very clearly seen from FIG. 11, the transverse web 15, with its hook-complementary formation 14 at each end, is also formed to be symmetrical with respect to the longitudinal axis of the contact support 4. It can moreover be seen that the end of the transverse web 15 is formed with its hook-complementary formation 14 as a free end projecting from the surface of the contact support 4. This hook-complementary formation 14 can therefore be produced very easily in a plastics injection molding procedure since this geometry can be reproduced in the corresponding injection molding tool and correspondingly easy removal from the mold is also realized.

FIGS. 12 and 13 show the arrangement and the cooperation of the latch hooks 13 and the hook-complementary formation 14 in detail, it can be seen that the contact support 4 is also prevented from moving out of the outer housing 5 under high loads as a result of the cooperation of the latch hooks 13 and the hook-complementary formation 14 of the contact support 4. This moving out (pressing out) of the contact support must be prevented in particular, and therefore effectively, when the socket 3 is plugged into the plug 2. This effective prevention is achieved by an undercut of the angles a and b that are formed both at the free ends of the latch hooks 13 and at the respective contact surface of the hook-complementary formation 14, and a defined load direction is ensured by the slight angled position of the latch hooks 13 with respect to the longitudinal axis of the plug-type connector 1. Moreover, a movement of the fastened latch hooks 13 (for example an opening movement) is prevented by the cooperation of the geometry shown and described above. In this case, the latch hooks 13 are prevented from tilting inward beyond the angle c (see FIG. 13, bottom left view) by the defined stop d on the contact support 4 (again, see FIG. 13, bottom left view).

While, in FIGS. 1 to 4, the construction and the mode of operation of an example of a plug-type connector are shown and have been described above, in FIGS. 5 to 13, based on this embodiment, the latch hook 13 on the outer housing 5 unlocking tool is shown in conjunction with the hook-complementary formation 14 on the outer housing 5 and has likewise been described above.

The secondary locking bar 6 that can be inserted into the contact support 4, is now described below on the basis of FIGS. 14 to 21.

It goes without saying that, like the latch hook 13 in conjunction with the hook-complementary formation 14, the embodiment and the associated description relating to the secondary locking bar 6 can be implemented alone in a plug. By way of contrast, a combination of both elements (secondary locking bar 6 and latch hook 13) is described and shown in all figures.

FIG. 14 shows the secondary locking bar 6 in two different views. It is essentially elongated and has an, in particular, flat longitudinal web 16. A latching element 17 is at each end of this longitudinal web 16. The latching element 17 is formed as a clip that extends at an approximate right angle from the longitudinal web 16 and at the end of which a step that, in particular, forms an undercut, is in turn arranged. An end face of the longitudinal web 16 is formed not at a right angle to the larger surface of the longitudinal web 16, but with a bevel and therefore forms a lead-in chamfer 18 along which the contact partners can slide as they are inserted into their contact chamber, and jamming is therefore prevented during this insertion procedure. Force-absorbing webs 19 are on the upper side of the longitudinal web 16. In this embodiment, 3 force-absorbing webs 19, arranged symmetrically over the longitudinal extent of the longitudinal web 16, are present. However, one, two or more than three force-absorbing webs 19 can also be provided, wherein the number is based on the configuration of the plug, in particular the number of contact partners thereof. Furthermore, in the region of the latching elements 17, an unlocking cutout 20 is present in the clip that, starting from the longitudinal web 16, extends at an approximate right angle. An unlocking tool can be inserted into this unlocking cutout 20, for which the contact support 4 has a complementary opening via which, not only can the secondary locking bar 6 be inserted, but via which the unlocking cutout 20 can also be actuated by the unlocking tool. Finally, the secondary locking bar 6 illustrated in this embodiment has a coding 21. In this case, the coding 21 is a cutout in a longitudinal side of the longitudinal web 16.

In FIG. 15, it is shown that, in the open state, the lead-in chamfer 18, when fitting the contacts (inserting the contact partners into their associated contact chambers), enables frictionless positioning of the respective contact partner in its associated contact chambers. The open state can, on the one hand, refer to the prelatching position of the secondary locking bar 6 in its contact support 4, in which it is possible to insert the contact partners into the contact chambers but they have not yet undergone secondary locking. The secondary locking only takes place when the secondary locking bar 6 has been brought from its prelatching position into its intended end latching position. However, the open state can also involve the contact support 4 not yet being inserted into the outer housing 5 or only being inserted to some extent therein.

FIG. 16 shows the locking procedure of the secondary locking bar 6, in which this is brought from the prelatching position into its intended end position. In this locking procedure of the secondary locking bar 6, a downwardly acting force is applied to the force-absorbing webs 19. This is shown in the view on the left in FIG. 16. The absorption of the force is indicated by the three arrows. This takes place, for example, with or without a tool, by hand or mechanically. During the movement of the secondary locking bar 6 from its prelatching position (visible in the center of FIG. 16) into its end latching position, the two latching elements 17 are thereby spread apart and, in the end position, snap back into their original position again in order to fasten the contact partners with secondary locking via the longitudinal web 16 of the secondary locking bar 6 that is then located in its end latching position. This can be seen in the view on the right of FIG. 16. It goes without saying that the secondary locking bar 6 has firstly been inserted into the contact support 4 and fastened in its prelatching position therein. In terms of their function, the latching elements 17 that form a latching geometry or an undercut geometry, are adapted to a mating latching geometry or a mating undercut geometry of the contact support 4. Such a mating geometry is formed, for example, as a projecting bead of the contact support 4 in the embodiment according to FIG. 16.

An unlocking procedure of the secondary locking bar 6 is illustrated in FIG. 17. In this unlocking procedure of the secondary locking bar 6, a corresponding unlocking mechanism is inserted into the unlocking cutouts 20 through a complementary opening in the contact support 4 (and optionally the outer housing 5, after the contact support 4 has been inserted as intended and completely into the outer housing 5) and the secondary locking bar 6 is pulled upward by means of this unlocking tool (as observed in FIG. 17) and therefore unlocked. As a result of this unlocking, it is possible, for example, for the contact partners (or at least only one or more contact partners) to be switched if fitted incorrectly or replaced if damaged.

It can be seen in FIG. 18 that the procedure of plugging the contact support 4 into its outer housing 5 is only possible in the closed state (end latching position) of the secondary locking bar 6. The relative movement (plugging the contact support 4 into the outer housing 5) is blocked by the still open secondary locking bar 6. In this case, open means that, although the secondary locking bar 6 has already been brought into its prelatching position in the contact support 4, the end latching position has not yet been reached. The secondary locking bar 6 dips with the force-absorbing webs 19 both into the contact support 4 and into the outer housing 5 and prevents the displacement of the system as a whole into its end latching position. This means that, although the contact support 4 has already been plugged into the outer housing 5 to some extent, a further plug-in movement is not yet possible owing to the blocking by the secondary locking bar 6. In this position of the contact support 4 with respect to the outer housing 5, it is possible to insert (fit) the contact partners into their contact chambers. In this position, the complementary geometries of the contact partners for the secondary locking thereof are not yet in contact with the secondary locking bar 6, in particular they do not yet form an undercut therewith (they have not yet come to lie lie against one another) and are therefore not yet secured in their intended end position (secondary locking). As a result of the actuation of the secondary locking bar 6 (also referred to as closing) that brings the secondary locking bar 6 from its prelatching position into its end latching position (see FIG. 19), the secondary locking mean 6 dips completely into the contact support 4 so that it no longer projects beyond the surface of the contact support 4. In other words, the secondary locking bar 6 no longer has an overlap with the outer housing 5. At the same time, the secondary locking bar 6 generates an undercut with the locking geometries of the contact partners for the secondary locking thereof and therefore ensures the correct positioning, i.e. the intended end position, of the contact partners in their contact chambers. Therefore, according to FIG. 19, each contact partner has then undergone secondary locking in its associated contact chamber.

The operating principle of the force-absorbing webs 19 is described with reference to FIG. 20. The illustrated geometry of the force-absorbing webs 19 always ensures the correct position of the respective contact partner in its contact chamber. In this case, the locking geometries of the respective contact partners (here denoted by the reference numeral 22) are in contact with the force-absorbing web 19 under a tensile load when the secondary locking bar 6 is located in its intended end position in the contact support 4. A displacement of the contact partner in its contact chamber is thus permanently and effectively prevented as a result of the contact with the contact support 4 (more precisely the contact chambers thereof).

Finally, in FIG. 21, the situation is shown in which the contact partners are quickly and easily replaceable in the completely assembled state of the plug 2. Moreover, the prelatching position and the end latching position of the secondary locking bar 6 in the assembled state of the plug 2 can be seen. The opening and closing (i.e. the movement of the secondary locking bar 6 from its prelatching position into its end latching position on the contact support 4 and vice versa) can take place in the completely assembled state of the plug 2, in which the contact support 4 has been plugged into the outer housing 5 completely. In this state, or also after the contact support 4 has been moved out of the outer housing 5, the secondary locking bar 6 can be opened and either a contact partner can be fitted if a contact chamber is missing a contact partner, or, in the event of damage, a damaged partner can be replaced by a new contact partner.

Moreover, the described configuration and assembly sequence of the secondary locking bar 6 has the advantage that the position of the secondary locking bar 6 during assembly of the plug 2 can be identified at multiple points and multiple times in order to ensure error-free assembly of the plug 2 or to detect faulty assembly. If the secondary locking bar 6 is installed in its prelatching position on the contact support 4, this can be identified at four points; more specifically, by the visible position nubs on the outer left and the outer right and by the two blocked webs to the left and right of center. In the end latching position, these dip completely into the contact support and are no longer visible. The position nubs and the two blocked webs can be seen in the view on the left in FIG. 21, whereas they are no longer visible in the view on the right in FIG. 21, which means that this change in state can be identified using appropriate detection means.

The invention claimed is:

1. A plug-type connector, comprising:

a plug;

a socket;

a contact support in the plug and formed with a plurality of contact chambers each constructed to receive a respective contact partner;

an outer housing of the plug holding the contact support, each contact partner undergoing primary locking in its respective contact chamber;

a secondary locking bar for secondary locking of the contact partners in their respective contact chambers;

a latch hook on the outer housing, extending at an acute angle to a center axis of the outer housing, and cooperating with the contact support; and a hook-complementary formation on the contact support and engageable with the latch hook.

2. The plug-type connector according to claim 1, wherein there are two of the latch hooks on the outer housing positioned thereon symmetrically to the center axis of the outer housing.

3. A plug-type connector, comprising:

a plug;

a socket;

a contact support in the plug and formed with a plurality of contact chambers each constructed to receive a respective contact partner;

an outer housing of the plug holding the contact support, each contact partner undergoing primary locking in its respective contact chamber;

a secondary locking bar for secondary locking of the contact partners in their respective contact chambers;

a latch hook on the outer housing, extending at an acute angle to a center axis of the outer housing, and cooperating with the contact support; and a hook-complementary formation on the contact support and engageable with the latch hook, a free end of the latch hook and the hook-complementary formation being formed with mutually complementary undercuts.

4. A plug-type connector, comprising:

a plug;

a socket;

a contact support in the plug and formed with a plurality of contact chambers each constructed to receive a respective contact partner;

an outer housing of the plug holding the contact support, each contact partner undergoing primary locking in its respective contact chamber;

a secondary locking bar for secondary locking of the contact partners in their respective contact chambers;

a latch hook on the outer housing, extending at an acute angle to a center axis of the outer housing, and cooperating with the contact support;

a hook-complementary formation on the contact support and engageable with the latch hook; and a transverse web having an end from which the hook-complementary formation extends from the center axis of the contact support.

5. The plug-type connector according to claim 4, wherein the end of the transverse web is formed with its respective hook-complementary formation as a free end projecting from the surface of the contact support.

* * * * *